US009478838B2

(12) United States Patent
Wolf et al.

(10) Patent No.: US 9,478,838 B2
(45) Date of Patent: Oct. 25, 2016

(54) ORTHOMODE COUPLER FOR AN ANTENNA SYSTEM

(75) Inventors: Helmut Wolf, Holzkirchen (DE); Michael Schneider, Neubiberg (DE)

(73) Assignee: Astrium GmbH, Taufkirchen (DE)

( * ) Notice: Subject to any disclaimer, the term of this patent is extended or adjusted under 35 U.S.C. 154(b) by 501 days.

(21) Appl. No.: 13/523,979

(22) Filed: Jun. 15, 2012

(65) Prior Publication Data

US 2012/0319799 A1 Dec. 20, 2012

(30) Foreign Application Priority Data

Jun. 16, 2011 (DE) ..... 10 2011 106 590

(51) Int. Cl.

*H01P 1/161* (2006.01)
*H01P 1/17* (2006.01)
*H01P 1/06* (2006.01)

(52) U.S. Cl.

CPC ..... *H01P 1/161* (2013.01); *H01P 1/066* (2013.01); *H01P 1/067* (2013.01); *H01P 1/171* (2013.01); *H01P 1/173* (2013.01)

(58) Field of Classification Search

CPC ..... H01P 1/161; H01P 5/02; H01P 1/171; H01P 1/173; H01P 1/066; H01P 1/165; H01P 1/067

USPC ... 333/21 A, 21 R, 137, 157, 256, 257, 261; 343/756

See application file for complete search history.

(56) References Cited

U.S. PATENT DOCUMENTS 6,750,735 B1 * 6/2004 Bertin et al. ..... 333/21 A

FOREIGN PATENT DOCUMENTS

DE 20 2009 006 651 U1 8/2009
GB 2 188 493 A 9/1987

OTHER PUBLICATIONS

Ming Hui Chen, "A wide-band square-waveguide array polarize", May 1973, "Antennas and Propagation" IEEE Transactions vol. AP-21, pp. 389-391.*

German Office Action dated Apr. 22, 2014 (five (5) pages).

Ihmels, R.; Papziner, U.; Arndt, F.: "Field theory design of a corrugated septum OMT", Microwave Symposium Digest, 1993, IEEE MTT-S International, S. 909-912 vol. 2, 1993, doi: 10.1109/MWSYM.1993.277034 (ieeexplore) (four (4) pages).

(Continued)

*Primary Examiner* — Benny Lee
*Assistant Examiner* — Jorge Salazar, Jr.
(74) *Attorney, Agent, or Firm* — Crowell & Moring LLP

(57) ABSTRACT

An orthomode coupler for an antenna system, particularly for a multi-feed antenna is provided. The orthomode coupler includes a first signal waveguide for a first RF signal that can propagate in the first signal waveguide, along a first axis, as well as a second signal waveguide for a second RF signal that can propagate in the second signal waveguide, along a second axis, where the second axis is disposed parallel to the first axis. Furthermore, the orthomode coupler includes a septum polarizer in which the first and second signal waveguide end, and a common signal waveguide having a third axis, along which a transmission and reception signal can propagate, where the third axis runs parallel to the first and the second axis, and where the common signal waveguide is coupled with the septum polarizer. The common signal waveguide includes a further polarizer.

4 Claims, 2 Drawing Sheets

(56) References Cited

OTHER PUBLICATIONS

Figure 1:
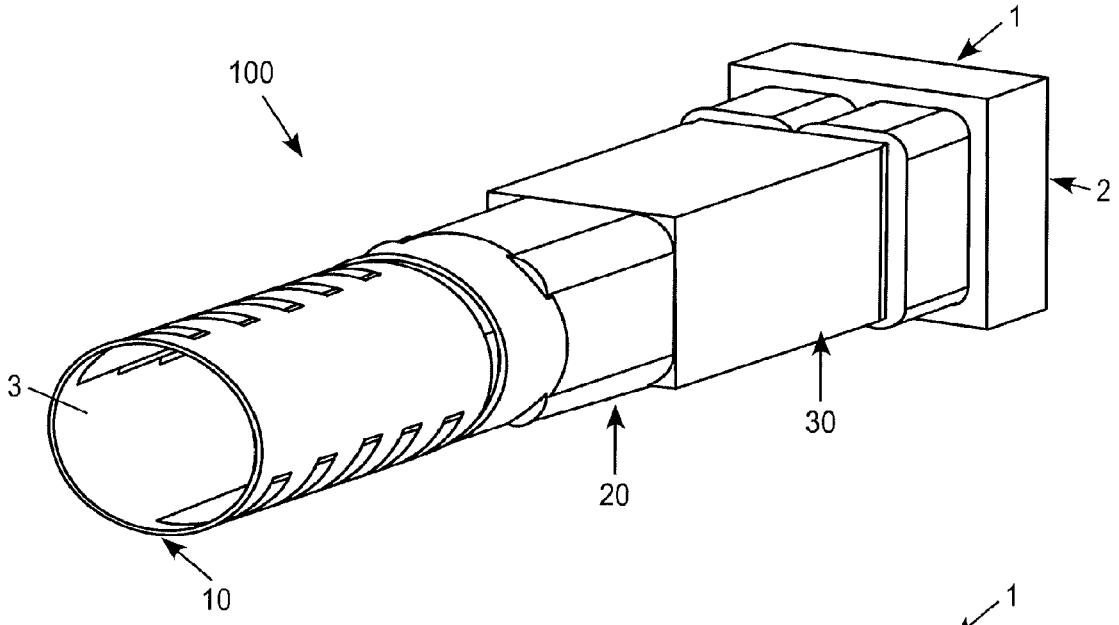

Tucholke, U.; Arndt, F.; Wriedt, T.: "Field Theory Design of Square Waveguide Iris Polarizers", IEEE Transactions on Microwave Theory and Techniques, vol. 34, No. 1, S. 156-160, Jan. 1986, doi: 10.1109/TMTT.1986.1133293 (ieeexplore) (six (6) pages).

Sarasa, P.; Diaz-Martin, M.; Angevain, J.-C.; Mangenot, C. ;"New Compact OMT Based an a Septum Solution for Telecom Applications", 32nd ESA/ESTEC Antenna Workshop, Noordwijk, The Netherlands, Oct. 5-8, 2010, (eight (8) pages).

European Search Report dated Sep. 26, 2012 with partial English translation (nine (9) pages).

Pablo Sarasa et al: New Compact OMT Based on a Septum Solution, Proceedings of the 5th European Conference on Antennas and Propagation (EUCAP), IEEE, Apr. 11, 2011, XP03877428 (five (5) pages).

Dang N D et al: "Compact Circularly Polarised Waveguide Element", Jan. 1, 1991, pp. 5/1-5/5, XP006522739.

Piovano B et al: "CAD and Optimization of Compact Wide-band Septum Polarizers", European Microwave Conference, 1999. 29th, IEEE, Piscataway, NJ, USA, Oct. 1, 1999, pp. 236-238, XP031067317.

* cited by examiner

ORTHOMODE COUPLER FOR AN ANTENNA SYSTEM

CROSS-REFERENCE TO RELATED APPLICATIONS

The present application claims priority under 35 U.S.C. §119 to German patent application 10 2011 106 590.7, filed Jun. 16, 2011.

BACKGROUND AND SUMMARY OF THE INVENTION

Exemplary embodiments of the present invention relate to an orthomode coupler for an antenna system, particularly for a multi-feed antenna. The orthomode coupler comprises a first signal waveguide for a first RF signal that can propagate in the first signal waveguide, along a first axis. It comprises a second signal waveguide for a second RF signal that can propagate in the second signal waveguide, along a second axis, where the second axis is disposed parallel to the first axis. The first and the second signal waveguide end in a septum polarizer. A transmission and reception signal can propagate along a third axis of a common signal waveguide of the orthomode coupler, where the third axis runs parallel to the first and the second axis, where the common signal waveguide is coupled with the septum polarizer.

Orthomode couplers separate or combine two orthogonal, linearly polarized waves. In this connection, the first and the second signal waveguide, which are also referred to as feed waveguides, usually stand perpendicular on one another. The orthogonal placement of the feed waveguides, which are usually configured as rectangular waveguides, is due to the assignment to polarizations that are orthogonal to one another, at the common gate (the common signal waveguide).

If the orthomode coupler is used in a multi-feed antenna system, great packing density of the orthomode coupler is required, thereby making parallel placement of its feed waveguide advantageous or actually compulsory. When the feed waveguides are conducted in parallel, however, it is difficult to ensure polarization purity over the greatest possible bandwidth.

An orthomode coupler is known from P. Sarasa, M. Diaz-Martin, J.-C. Angevain, C. Mangenot: "New Compact OMT Based on a Septum Solution for Telecom Applications," 32$^{nd}$ ESA Antenna Workshop, 2010, which coupler has rectangular feed waveguides disposed in parallel. Because of the parallel placement of the feed waveguides, this orthomode coupler can easily be integrated into multi-feed antenna systems. A disadvantage of the orthomode coupler described in the publication is its small bandwidth. Furthermore, its polarization is tilted by 45° relative to the field intensity vectors in the signal waveguides. This tilting by 45° makes direct connection of a distributor network more difficult, and makes the use of so-called twists necessary, if applicable.

Accordingly, exemplary embodiments of the present invention provide an orthomode coupler in which a great bandwidth and great polarization purity can be achieved, in comparison with the variants known from the state of the art.

The invention provides an orthomode coupler for an antenna system, particularly for a multi-feed antenna. The orthomode coupler comprises: a first signal waveguide for a first RF signal that can propagate in the first signal waveguide, along a first axis; a second signal waveguide for a second RF signal that can propagate in the second signal waveguide, along a second axis, where the second axis is disposed parallel to the first axis; a septum polarizer in which the first and second signal waveguide end; and a common signal waveguide having a third axis, along which a transmission and reception signal can propagate, where the third axis runs parallel to the first and the second axis, and where the common signal waveguide is coupled with the septum polarizer. According to the invention, the common signal waveguide comprises a further polarizer.

The orthomode coupler according to the invention therefore combines a septum polarizer with a further polarizer. In the transmission case, a circularly polarized wave is first generated by the septum polarizer. This wave is converted to a linearly polarized wave by the polarizer. In the reception case, the polarizer generates a circularly polarized wave from a linearly polarized wave. The septum polarizer generates a linearly polarized wave from the circularly polarized wave. In this way, it is possible to adjust the direction of the polarization vector in any desired manner. Furthermore, a high level of cross-polarization suppression is achieved over a great bandwidth by means of the combination. Likewise, the orthomode coupler according to the invention makes a high level of polarization purity available.

In particular, it is provided that the first RF signal in the first signal waveguide and the second RF signal in the second signal waveguide are polarized orthogonal to one another. In other words, this means that polarizations that are orthogonal to one another are assigned to the inputs of the septum polarizer.

The further polarizer can optionally be configured as a groove polarizer, as a crosspiece polarizer, or as a post polarizer. The cross-section of the further polarizer can optionally be configured to be round or rectangular.

In particular, it is practical if the septum polarizer and the further polarizer are connected with one another by way of a coupling element. It is particularly preferred, in this connection, if the coupling element has a round cross-section, so that the septum polarizer and the further polarizer can be rotated relative to one another about its central axis. The direction of the polarization vector can be adjusted as desired, in simple manner, by means of a rotation of the further polarizer about its central axis.

The orthomode coupler according to the invention is configured, by means of the combination of the septum polarizer with a further polarizer, in such a manner that the frequency response of the septum polarizer is partially compensated by the frequency response of the further polarizer. The bandwidth and the polarization purity are significantly improved, as compared with the solutions known from the state of the art, by means of the reciprocal compensation of the frequency response of the septum polarizer and the further polarizer.

BRIEF DESCRIPTION OF THE DRAWING FIGURES

Figure 2:
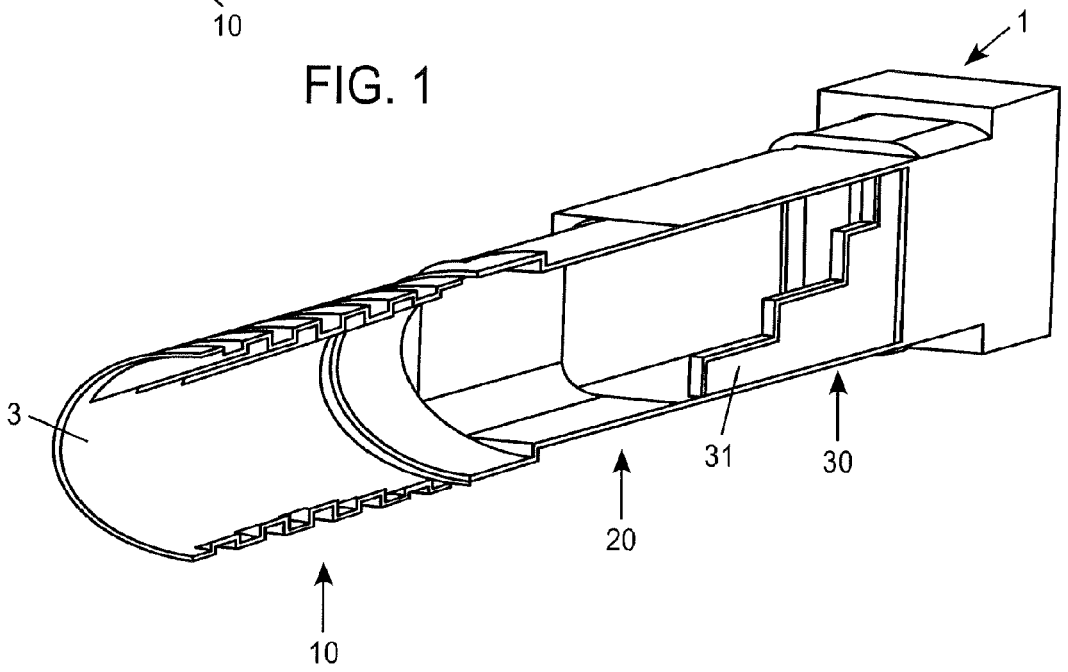
Figure 3:
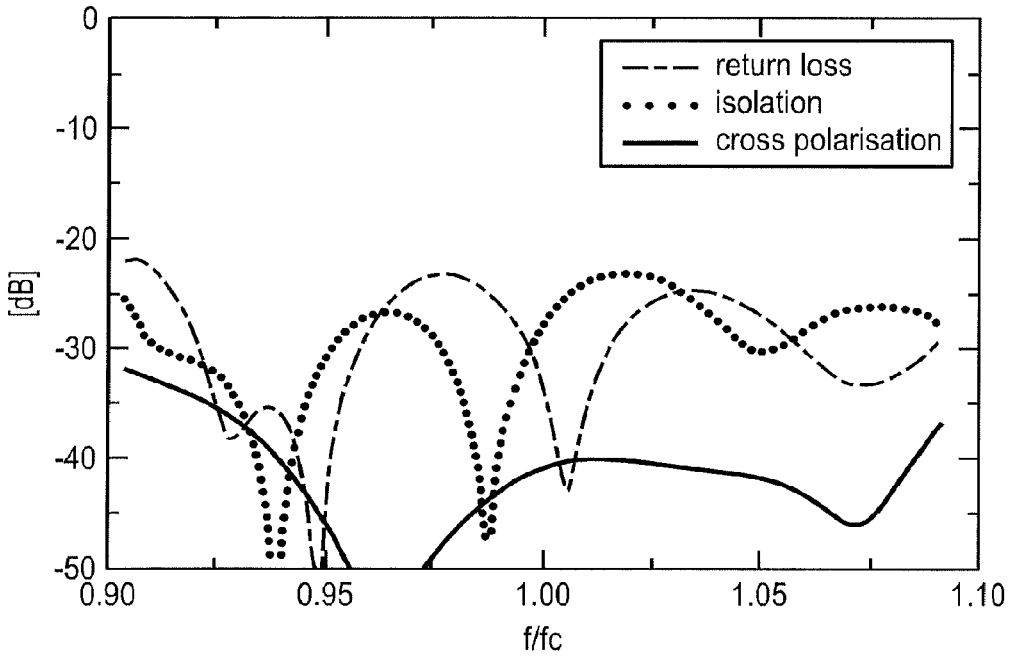

The invention and its advantages will be explained further in the following, using an exemplary embodiment in the drawing. This shows:

FIG. 1 a schematic, perspective representation of an orthomode coupler according to the invention, FIG. 2 a sectional, perspective representation of the orthomode coupler according to the invention from FIG. 1, and FIG. 3 a diagram that illustrates the performance data of the orthomode coupler according to the invention.

DETAILED DESCRIPTION

FIG. 1 shows a schematic, perspective representation of an orthomode coupler 100 for an antenna system, according to the invention. In particular, it is possible to use the orthomode coupler in a multi-feed antenna system, because of the compact construction of the orthomode coupler 100 according to the invention.

In known manner, the orthomode coupler 100 has two signal waveguides 1, 2 having axes oriented parallel to one another and having a rectangular cross-section, in each instance, along which waveguides RF signals that are polarized orthogonal to one another can propagate, in each instance. The signal waveguides 1, 2 end in a septum polarizer 30 that also has a rectangular cross-section. It is evident from the sectional representation in FIG. 2 that a septum 31 of the septum polarizer 30 is configured to be stepped. The septum 31 divides the housing of the septum polarizer 30 into two chambers of equal size. The septum polarizer 30 is coupled, by way of a coupling element 20 that has an essentially rectangular cross-sectional shape, with a further polarizer 10 having a round cross-section, which ends in a common signal waveguide 3 or forms it, in a manner according to the invention. The further polarizer 10 is round in cross-section and is configured as a groove polarizer in this exemplary embodiment. Likewise, the further polarizer 10 could be structured as a crosspiece polarizer or post polarizer or some other type of polarizer that has the properties indicated below.

In an embodiment also not shown in a figure, the cross-section of the coupling element 20 could also be round. In this way, the septum polarizer and the further polarizer could be rotated relative to one another in simple manner, where a rotation about the central axis of the further polarizer 10 takes place. In this way, a polarization vector can be adjusted as desired.

The orthomode coupler 100 according to the invention is therefore based on the combination of a septum polarizer 30 and a further polarizer 10. In the transmission case, a circularly polarized wave is first produced by the septum polarizer by means of this combination. This wave is converted to a linearly polarized wave by means of the polarizer 10. In the reception case, the polarizer 10 generates a circularly polarized wave from a linearly polarized wave, where the septum polarizer 30 in turn generates a linearly polarized wave from the circularly polarized wave.

An advantage of this method of procedure is that the direction of the polarization vector can be adjusted as desired. Furthermore, the bandwidth and the polarization purity are significantly increased as compared with the orthomode couplers known from the state of the art, by means of the reciprocal compensation of the frequency response of the septum polarizer 30 and of the further polarizer 10.

A further effect of the orthomode coupler according to the invention is that the frequency response of the septum polarizer is partially compensated by means of the frequency response of the further polarizer. In this way, great polarization suppression is achieved over a clearly greater bandwidth, more than is the case for orthomode couplers having parallel signal waveguides of a different construction.

FIG. 3 shows a diagram in which the performance data of the orthomode coupler 100 according to the invention are shown. A frequency ratio f/fc is shown on the abscissa. The scattering parameters are shown on the ordinate, in dB. K1 refers to the cross-polarization. K2 refers to isolation. K3 illustrates backscatter.

The properties of the orthomode coupler, which are improved as compared with known solutions, with simultaneously little construction space, result from the fact that the frequency response of the septum polarizer is partially compensated by the frequency response of the further polarizer. In this way, a high level of polarization suppression is achieved over a greater bandwidth, as compared with the orthomode coupler according to Sarasa et al.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An orthomode coupler for an antenna system, comprising:

a first signal waveguide for a first RF signal that can propagate in the first signal waveguide, along a first axis to an end of the first signal waveguide;

a second signal waveguide for a second RF signal that can propagate in the second signal waveguide, along a second axis to an end of the second signal waveguide, where the second axis is disposed parallel to the first axis;

a septum polarizer, wherein the ends of the first and second signal waveguides terminate at a first end of the septum polarizer; and a common signal waveguide having a third axis, along which a transmission and reception signal can propagate, where the third axis runs parallel to the first and the second axis, and where the common signal waveguide is coupled with a second end of the septum polarizer disposed opposite to the first end of the septum polarizer, wherein the common signal waveguide comprises a further polarizer, wherein the further polarizer is a non-septum polarizer having a round cross-section;

wherein the septum polarizer and the further polarizer are connected with one another by way of a coupling element disposed at the second end of the septum polarizer, and wherein the coupling element has a round cross-section that is configured to allow the septum polarizer and the further polarizer to be rotated relative to one another about a central axis of the coupling element, wherein the coupling element is connected directly to the second end of the septum polarizer.

2. The orthomode coupler according to claim 1, wherein the first RF signal in the first signal waveguide and the second RF signal in the second signal waveguide each generate a signal in the third waveguide which are polarized orthogonal to one another.

3. The orthomode coupler according to claim 1, wherein the further polarizer is structured as a groove polarizer, a crosspiece polarizer, or a post polarizer.

4. The orthomode coupler according to claim 1, wherein the orthomode coupler is configured in such a manner that a frequency response of the septum polarizer is partially compensated by a frequency response of the further polarizer.

* * * * *